US006626521B1

(12) United States Patent
Nozawa

(10) Patent No.: US 6,626,521 B1
(45) Date of Patent: Sep. 30, 2003

(54) LIQUID JET RECORDING HEAD, METHOD FOR MANUFACTURING SAME AND LIQUID JET RECORDING APPARATUS

(75) Inventor: Minoru Nozawa, Machida (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/429,464

(22) Filed: Apr. 27, 1995

Related U.S. Application Data

(63) Continuation of application No. 07/955,034, filed on Oct. 1, 1992, now abandoned.

(30) Foreign Application Priority Data

Oct. 3, 1991 (JP) ..... 3-256543

(51) Int. Cl.[7] ..... B41J 2/05
(52) U.S. Cl. ..... 347/63
(58) Field of Search ..... 347/63, 65, 47

(56) References Cited

U.S. PATENT DOCUMENTS

| | | | | |
|---|---|---|---|---|
| 4,313,124 A | | 1/1982 | Hara | |
| 4,345,262 A | | 8/1982 | Shirato et al. | |
| 4,394,670 A | * | 7/1983 | Sugitani et al. | 347/65 |
| 4,412,224 A | | 10/1983 | Sugitani | 347/65 |
| 4,417,251 A | | 11/1983 | Sugitani | |
| 4,459,600 A | | 7/1984 | Sato et al. | |
| 4,463,359 A | | 7/1984 | Ayata et al. | |
| 4,521,787 A | * | 6/1985 | Yokota et al. | 347/65 |
| 4,558,333 A | | 12/1985 | Sugitani et al. | |
| 4,657,631 A | * | 4/1987 | Noguchi | 216/27 |
| 4,666,823 A | | 5/1987 | Yokota et al. | 430/320 |
| 4,698,645 A | | 10/1987 | Inamoto | 347/65 |
| 4,723,129 A | | 2/1988 | Endo et al. | |
| 4,740,796 A | | 4/1988 | Endo et al. | |
| 4,775,445 A | | 10/1988 | Noguchi | 216/27 |
| 5,030,317 A | | 7/1991 | Noguchi | 216/27 |
| 5,126,768 A | | 6/1992 | Nozawa et al. | |
| 5,760,803 A | * | 6/1998 | Yamamoto et al. | 347/47 |

FOREIGN PATENT DOCUMENTS

| | | |
|---|---|---|
| EP | 0370776 | 5/1990 |
| JP | 57043876 | 3/1982 |
| JP | 59123670 | 7/1984 |
| JP | 59138461 | 8/1984 |

* cited by examiner

*Primary Examiner*—John Barlow
*Assistant Examiner*—Michael S. Brooke
(74) *Attorney, Agent, or Firm*—Fitzpatrick, Cella, Harper & Scinto

(57) ABSTRACT

The present invention provides a method for manufacturing a liquid jet recording head, comprising the steps of providing a liquid jet recording head sub-assembly; polishing a surface of the sub-assembly on which the discharge openings are to be formed; and removing the filler from the liquid passages. Method further comprises a step of curing the filler to become harder than the pencil hardness H before the polishing step. The present invention further provides a liquid jet recording head manufactured by the above method, and a liquid jet recording apparatus including such recording head.

2 Claims, 6 Drawing Sheets

LIQUID JET RECORDING HEAD, METHOD FOR MANUFACTURING SAME AND LIQUID JET RECORDING APPARATUS

This application is a continuation of application Ser. No. 07/955,034 filed Oct. 1, 1992, now abandoned.

BACKGROUND OF THE INVENTION

1. Field of the Invention

The present invention relates to a liquid jet recording head for used with an ink jet recording system to generate small recording liquid droplets, a method for manufacturing such a recording head, and a recording apparatus having such a recording head.

2. Related Background Art

Liquid jet recording heads used with ink jet recording systems (liquid jet recording systems) generally comprise small recording liquid discharge openings, liquid passages, and liquid discharging energy generating portions disposed in the liquid passages. An example of a method for manufacturing such conventional liquid jet recording heads is disclosed in the Japanese Patent Application Laid-open No. 57-43876. More particularly, in this conventional method, a photosensitive compound layer (for example, negative tipe dry film LAMINAR (manufactured by DYNA CHEMICAL Co.), SR-1000G-50 (manufactured by HITACHI KASEI Co., Ltd.), SR-1000N (manufactured by HITACHI KASEI Co., Ltd) or the like) is deposited on a substrate on which energy generating bodies are arranged, and then hardened or cured areas are formed by performing predetermined pattern exposure. Thereafter, ink liquid passages (also referred to as "nozzles" hereinafter) are formed on a surface of the substrate by removing the non-cured compound from the photosensitive compound layer. Further, a liquid chamber forming member (lid plate) is bonded to the surface of the substrate via an adhesive layer to form two pairs of liquid jet recording heads. Thereafter, the assembly is cut by a diamond blade to separate two pairs of heads and at the same time to form liquid discharge openings, thereby obtaining individual liquid jet recording heads. According to this conventional method, it is possible to form the liquid passages very uniformly and to manufacture the heads in great quantities, since the photo-lithographic technique can be used.

However, this conventional method has the following drawbacks.

(1) In steps from a nozzle forming step to a cutting step, particularly, in the cutting step, cut powder and/or dirt in a cutting liquid enter into the nozzles, thus worsening the yield rate.

(2) During the cutting operation, a so-called "chipping" occurs around the discharge openings, which causes the incorrect discharging direction for the recording liquid droplets, thereby deteriorating the recording quality and worsening the yield rate. The "chipping" means a phenomenon that edges of the discharge openings are broken during machinging operations such as the cutting of the discharge openings, the polishing of the discharge openings and the like.

(3) In order to prevent the occurrence of the pitching during the cutting operation, a diamond blade of resin bond type must be used. However, such a diamond blade makes the cutting speed slower and the cost of the cutting operation more expensive. Further, since such diamond blade is worn away relatively rapidly, it is difficult to control the accuracy (normally, about ±10 $\mu$m) of the head.

(4) Particularly, in heads of high density multi-array type (i.e., type wherein a multiple of nozzles are arranged along an elongated width of A4 or A3 size), it is very difficult to form all of the nozzles correctly.

In order to eliminate the above-mentioned conventional drawbacks, the following method has been proposed. That is to say, a solid layer is deposited on a substrate at locations where nozzles are to be formed, and the solid layer is covered by a layer made of active energy ray curable material (nozzle forming material) and then a liquid chamber forming member is arranged on such layer. Then, the active energy ray curable material is cured by the active energy rays. Thereafter, the assembly is cut by a diamond blade at a high speed to separate two pairs of heads. Then, a discharge opening surface is polished to remove the pitching generated during the cutting operation, thereby finishing the discharge opening surface. Finally, by dissolving the solid layer by a removing liquid to remove the solid layer, thereby forming the nozzles.

According to this method, in the steps from the nozzle pattern forming step to the polishing step, since the interior of each nozzle is filled by the solid layer, the dirt can be prevented from being enter into the nozzles during such steps. Further, since the polishing operation is used, it is no need to prevent the pitching during the cutting operation, thereby permitting the faster cutting operation. This is effective, particularly in the manufacture of the head of high density multi-array type.

However, this conventional method still arises a problem that the broken portions (at about 10 points) are generated around the discharge openings in the manufacture of the head of high density multi-array type, although the occurrence of the pitching can be greatly suppressed. (The total number of nozzles is about 4700 in a head having the nozzle density of 400 DPI and a dimension of A3 size; thus, if the broken portions are 10, the rate of occurrence of the broken portion per nozzle will be about 0.2%).

SUMMARY OF THE INVENTION

An object of the present invention is to provide a unique method for manufacturing a liquid jet recording head, which can eliminate the above-mentioned conventional drawbacks and which is particularly effective in the manufacture of a liquid jet recording head of high density multi-array type.

In order to achieve the above object, according to an aspect of the present invention, there is provided a method for manufacturing a liquid jet recording head wherein a solid layer having at least one liquid passage pattern and made of resin soluble in a solid layer removing liquid, and a liquid passage wall forming material layer for covering the solid layer are interposed between a substrate and a lid plate to form a liquid jet recording head sub-assembly, then, the sub-assembly is cut at a discharge opening forming portion, and then the cut surfaces are polished, and thereafter the solid layer is removed, and wherein, before the polishing step, the solid layer is cured up to the pencil hardness H or more.

According to another aspect of the present invention, there is provided a method for manufacturing a liquid jet recording head wherein a photosensitive compound layer is laminated on a substrate, then liquid passages are formed, and then a lid plate is laminated on the compound layer to form a liquid jet recording head sub-assembly, and thereafter a filler is loaded into the liquid passages, and then the cutting operation, polishing operation and filler removing operation are successively performed, and wherein, before the polishing operation, the filler is cured up to the pencil hardness H or more.

The present invention was created on the basis of the following knowledge.

That is to say, the inventors found that the chipping areas (broken portions) which generated during the polishing operation of the discharge opening surface were concentrated at the edges of the discharge openings. Since the solid layer has relatively low hardness (softer), it is considered that the foreign matters enter into the solid layer during the polishing operation to interfere with the edges of the discharge openings, thereby occurring the chipping. It is assumed that the reason why this fact was not remarked conventionally is that, since the solid layer provided in correspondence to the ink passages was to be finally removed in the liquid jet recording head, the softer solid layer (easy to remove) was preferable so long as it can ensure the dimension and configuration of the ink passages precisely.

In consideration of the above, the inventors found that the edges of the discharge openings having substantially no chipping could be obtained by increasing the hardness of the solid layer by curing the solid layer in correspondence to the ink passages to prevent the foreign matters from entering into the solid layer. On the basis of this knowledge, after various test and investigation, the inventors found that when the solid layer had the pencil hardness of H or more, preferably 2H or more, and more preferably 3H or more, the above effect could be satisfactorily obtained.

Incidentally, the pencil hardness is based on the test pencil hardness defined by the Japanese Industrial Standard K5400-6:14(3), and the test machine was in accordance with the Japanese Industrial Standard K5401. The testing method was in accordance with the Japanese Industrial Standard K6894.

DETAILED DESCRIPTION OF THE PREFERRED EMBODIMENTS

Figure 5:
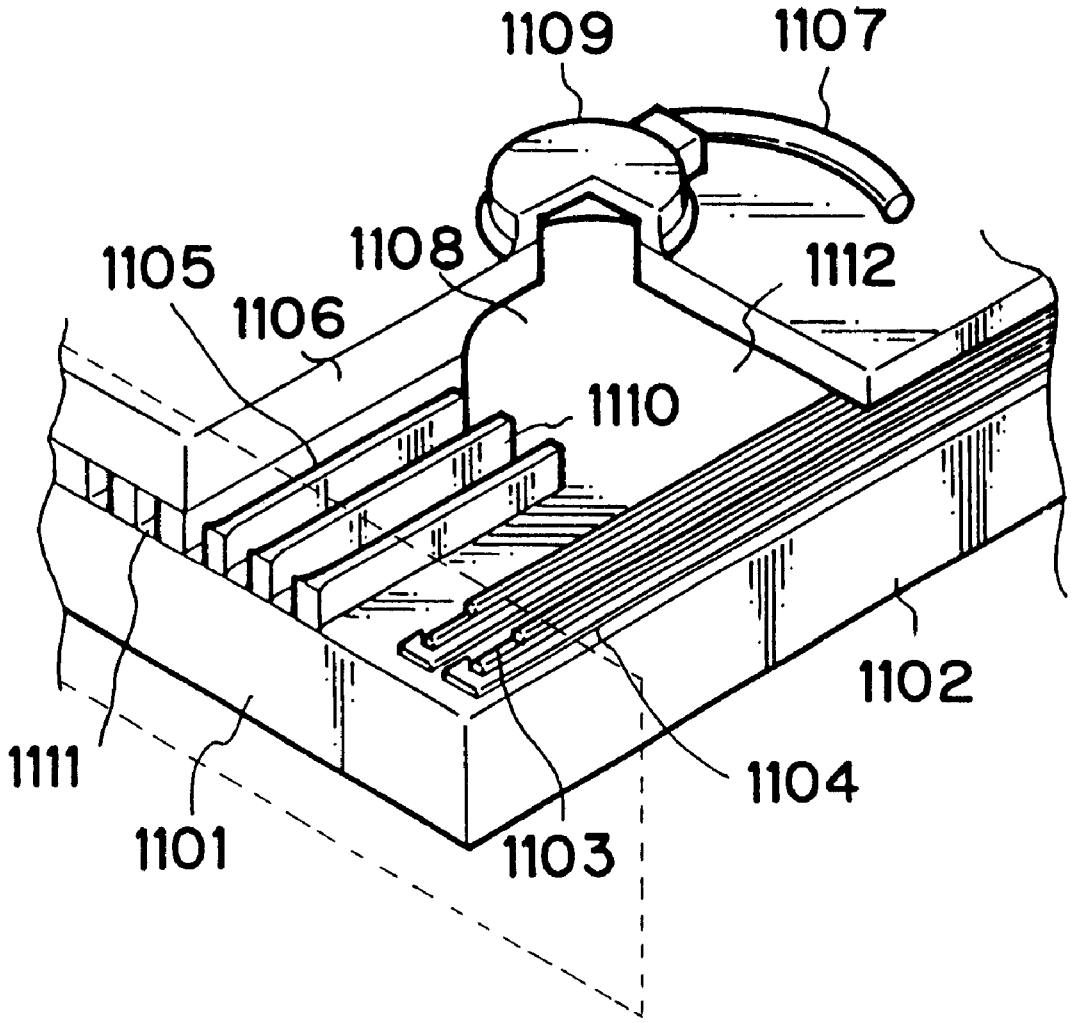
FIG. 5 is a partial perspective view of a liquid jet recording head.

FIG. 5 is a perspective view of an ink jet recording head which comprises heating portions 1103 of electro-thermal converters formed on a substrate 1102 by a film forming technique via a semi-conductor process such as the etching, depositing, spattering and the like, electrodes 1104, liquid passage defining walls 1105, and a lid plate 1106. Recording liquid 1112 is supplied from a liquid reservoir (not shown) to a common liquid chamber 1108 of the recording head 1101 via a liquid supply tube 1107. Incidentally, the reference numeral 1109 denotes a liquid supply tune connector. The liquid 1112 supplied to the common liquid chamber 1108 is supplied to liquid passages 1110 by a so-called capillary phenomenon, and constitutes meniscuses at discharge openings positioned at free ends of the liquid passages. By energizing the heat generating portions 1103 of the electro-thermal converters, the liquid portions on the heat generating portions 1103 are rapidly heated to form bubbles in the liguid passages. By the growth and contraction of each bubble, the liquid is discharged from the corresponding discharge opening 1111 as a liquid droplet. With the arrangement as mentioned above, it is possible to obtain an ink jet recording head of multi-nozzle type wherein 128 or 256 discharge openings are arranged on the discharge opening surface in correspondence. to the whole recording area with high discharge opening arrangement density of 16 nozzles/mm.

FIGS. 3A–3F are schematic perspective views showing steps of a method for manufacturing a liquid jet recording head according to an embodiment of the present invention. A solid layer 8 made of positive type photosensitive resin, for example, is formed on a substrate 1 on which a plurality of energy generating bodies are arranged, in such a manner that the solid layer covers the energy generating bodies (see FIG. 3A). Then, a liquid passage wall forming layer 2 is laminated on the solid layer 8 to cover the latter (see FIG. 3B). Then, a light permeable lid plate 4 having liquid supply openings is laminated on the layer 2 (see FIG. 3C). Then, a portion corresponding to the common liquid chamber is masked, and the exposure is effected from a direction shown by the arrows to make the solid layer 8 soluble in a solvent.

Figure 3A:
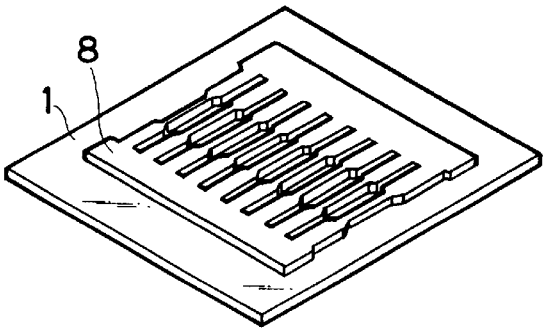
FIGS. 3A to 3F are schematic perspective views showing steps of a method for manufacturing a liquid jet recording head according to an embodiment of the present invention.
Figure 3B:
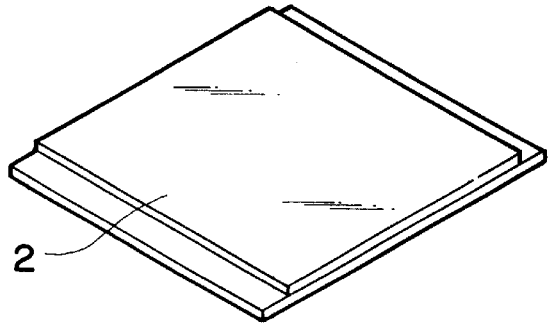
Figure 3C:
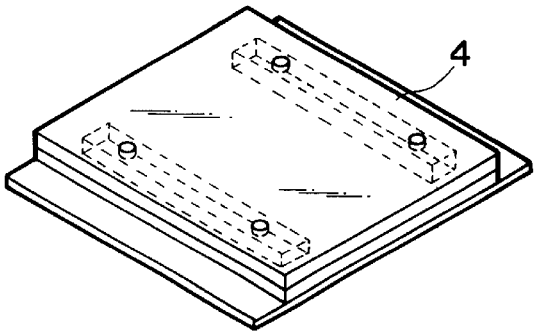
Figure 3D:
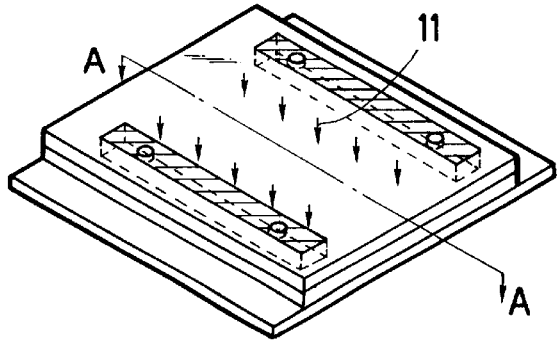
Figure 3E:
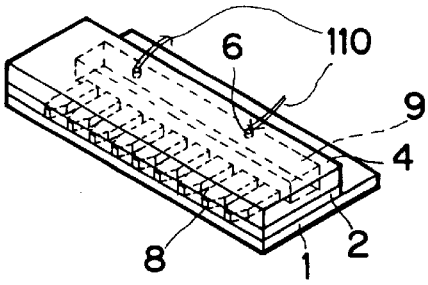
Figure 3F:
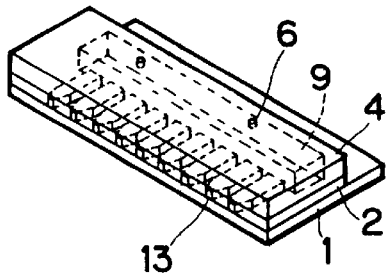
Figure 4A:
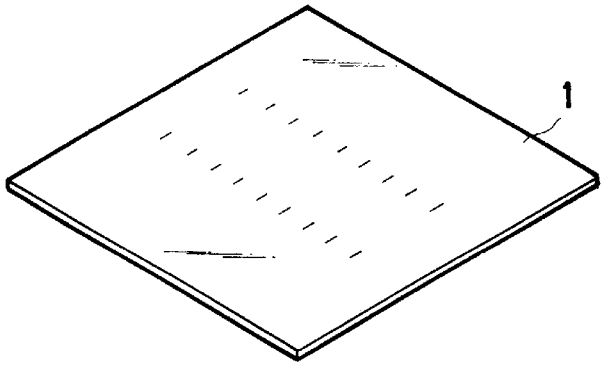
FIGS. 4A to 4D are schematic perspective views showing steps of a method for manufacturing a liquid jet recording head according to another embodiment of the present invention.
Figure 4B:
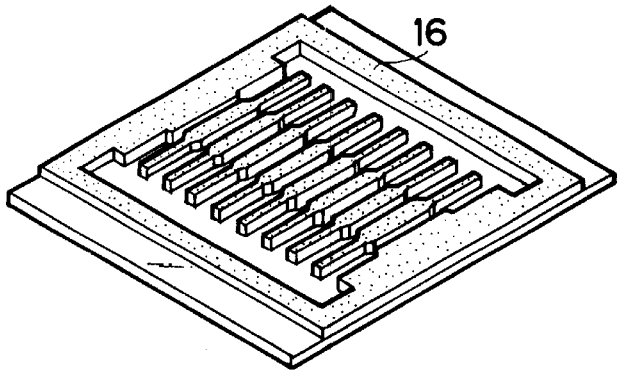
Figure 4C:
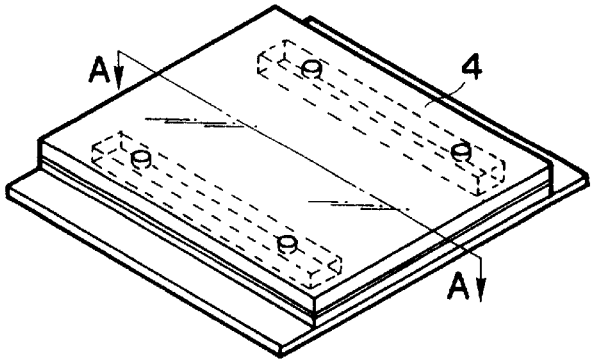
Figure 4D:
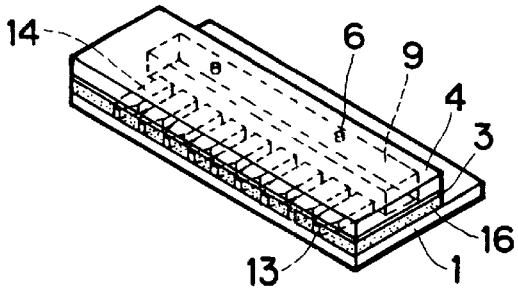

Thereafter, the sub-assembly is cut along the line A–A' at a discharge opening forming portion (see FIG. 3D). The solvent is circulated via the liquid supply openings 6 (to the common chamber 9) as shown in the arrows 110, thereby dissolving the solid layer 8 and removing the latter (see FIG. 3E). The discharge opening forming portion is polished to form the discharge openings (see FIG. 3F).

In the present invention, the solid layer in the recording head sub-assembly so formed is cured by thermal curing technique and the like up to the pencil hardness H or more, before the polishing operation.

The substrate used in the present invention is preferably made of glass, silica or the like, so that the heads can be manufactured in great quantities and the smoothness of surface can easily be achieved. Further, the solid layer is preferably made of any material which permits the patterning of the liquid passage configuration and has the water-resistance property and which is easy to be dissolved and removed. More specifically, the solid layer may be made of resin material such as positive type dry film, positive type liquid resist or the like. The liquid passage wall forming material is preferably ultraviolet ray curable material in consideration of the mass-production of the heads, and, more particularly, it may be epoxy resin, acrylic resin, diglycol-dialkyl carbonate resin, unsaturated polyester resin, polyurethane resin, polyimide resin, melamine resin, phenol resin, urea resin or the like.

Particularly, epoxy resin which can initiate the cationic polymerization by light, acryl oligomers having acrylester group which can permits the radical polymerization by light, photopolymerization resin including polythiol and polyene, and unsaturated cycloacetal resin are suitable for the constructural material because they have the faster polymerization speed and provide the stable polymer. The lid plate is preferably made of glass, particularly, for example, Pilex 7059 (trade mark, Corning Co.) or Tenpax (trade mark, Shot Co.) because they are permeable to active energy rays such as ultraviolet rays and have good anti-medicine property.

Further, polishing material used in the polishing operation is preferably ones used to polish the glass. More specifically, ROX-FP (trade mark, TOHOKU KINZOKU Co. in Japan) or ROM-M3 (trade mark, TOHOKU KINZOKU Co.) having cerium oxide as a main component is preferable. Such polishing material is dissolved in water to form polishing liquid. Incidentally, the polishing material or agent has fine particles having a diameter of about 1–2 $\mu$m, which particles are condensed under the dry condition to provide the firm cohesion. Further, polisher used in the polishing operation is preferably polyurethane in consideration of the durability. The solid layer removing liquid used after the polishing operation is preferably caustic soda, ethyl acetate solvent or the like. Incidentally, it should be noted that the present invention is not limited to the above-mentioned materials.

Figure 1:
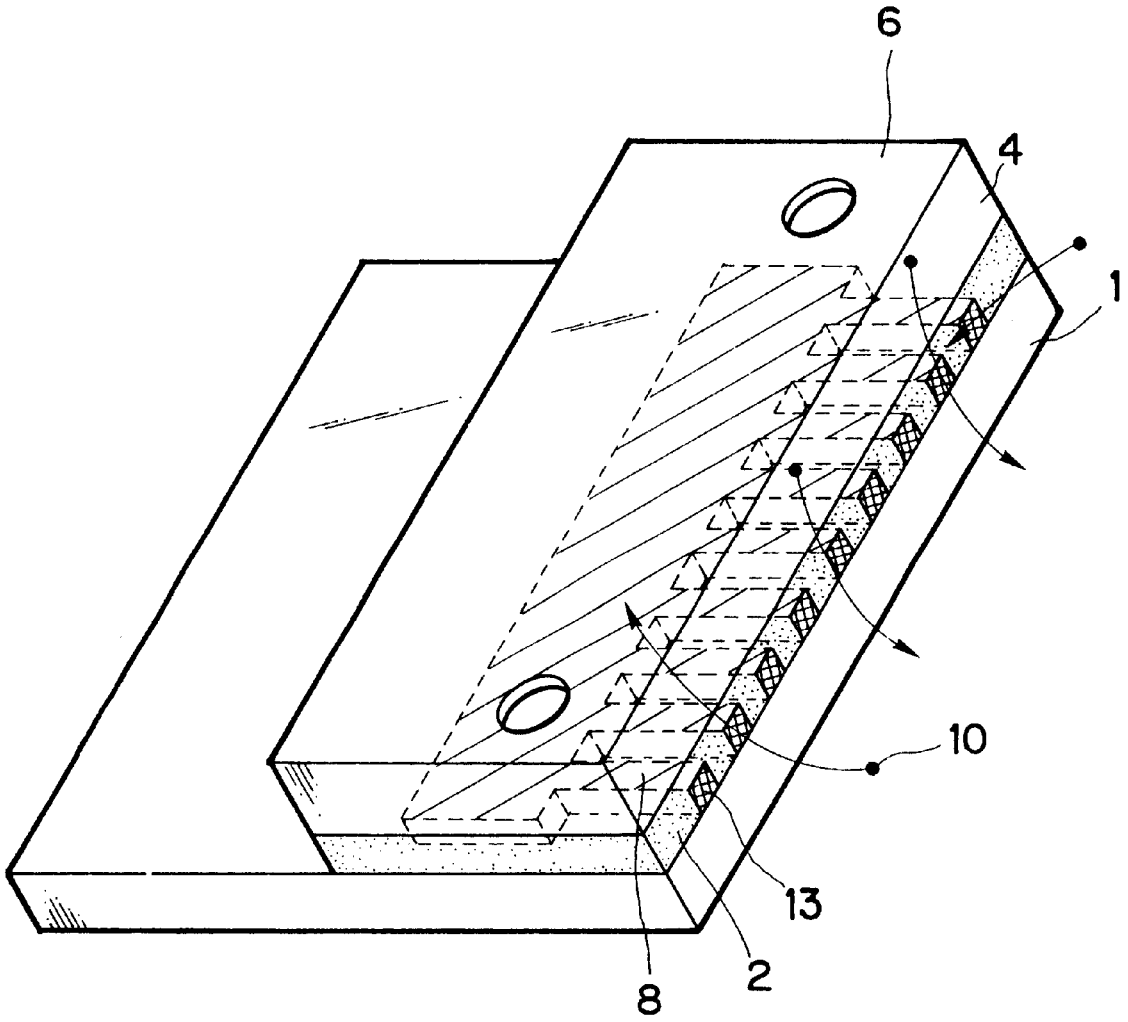
FIG. 1 is a schematic perspective view of a recording head sub-assembly showing a cut surface after a cutting operation.

The present invention will be further fully explained with reference to the accompanying drawings. FIG. 1 is a perspective view of a recording head sub-assembly showing a cross-section or cut surface after the cutting operation.

Normally, since the polishing particles are very small as mentioned above and the polisher acting as the polishing surface serves also as a buffer, the polishing particles themselves do not cause the pitching. However, after the polishing particles condensed to each other or when the dirt or other foreign matters 10 enters into the polishing material, the chipping will apt to occur frequently. Such foreign matters 10 reach around the discharge opening from various directions during the polishing operation. This is inevitable in the polishing operation. In this case, if the solid layer 8 is extremely soft as in the conventional case, after the foreign matters penetrate into the solid layer 8, they are caught by the edges of the discharge openings in the lid plate and/or the liquid passage wall forming material layer, thus causing the chipping.

Now, the inventors found the following fact and created the present invention. That is to say, the solid layer is thermally cured before the polishing operation. This thermal curing operation may be effected before or after the cutting operation. Further, before the polishing operation, a machining operation may be effected as an intermediate step. When the solid layer is cured, it has the hardness greater than the pencil hardness H and the water-resistance property. Accordingly, the foreign matters cannot penetrate into the solid layer from the discharge openings, thus preventing the pitching. Further, since the cured solid layer can be easily removed by caustic soda or ethyl acetate solvent in the later step, the problem regarding the residual matters in the liquid passage formation can be solved.

According to another embodiment of the present invention, as shown in FIGS. 4A to 4D, a photosensitive compound layer 16 is formed on the substrate 1, and then the liquid passages are formed, and thereafter, a lid plate 4 is laminated on the compound layer 16.

In the present invention, after the liquid passages in the recording head sub-assembly so formed is filled with a filler, the cutting, thermal curing, polishing and filler removing operations are effected successively. Alternatively, the filler may be loaded after the cutting operation. The filler is preferably positive type resist, and the thermal curing may be effected for 10–20 minutes under the temperature of 130° C. Since the steps other than the filler loading step are the same as those in the previous embodiment, the explanation of such steps will be omitted.

According to the present invention, an excellent effect can be obtained in a recording head and a recording apparatus of a type in which ink is discharged by utilizing thermal energy to form ink droplets among the ink jet recording apparatuses.

It is preferable to employ the typical structure and the principle of structures disclosed in, for example, U.S. Pat. Nos. 4,723,129 and 4,740,796. This system can be adopted in a so-called "On-Demand" type and "Continuous" type structures.

Briefly explaining, in this system, an electro-thermal conversion member disposed to align to a sheet or a liquid passage in which liquid (ink) is held is supplied with at least one drive signal which corresponds to information to be recorded and which enables the temperature of the electro-thermal conversion member to be raised higher than a nuclear boiling point, so that thermal energy is generated in the electro-thermal conversion member and film boiling is caused to take place on the surface of the recording head which is heated. In this way, since bubbles can be respectively formed in liquid (ink) in response to the drive signals to be applied to the electro-thermal conversion members, this system is particularly suitable for the On-Demand type recording method. Due to the enlargement and contraction of the bubble, liquid (ink) is discharged through the discharge opening or port, so that at least one liquid droplet is formed. In a case where the aforesaid drive signal is made to be a pulse signal, a further satisfactory effect can be obtained in that the bubble can immediately and properly be enlarged/contracted and liquid (ink) can be discharged while exhibiting excellent responsibility. It is preferable to employ a drive signal of the pulse signal type disclosed in the U.S. Pat. Nos. 4,463,359 and 4,345,262. Furthermore, in a case where conditions for determining the temperature rise ratio on the aforesaid heated surface disclosed in the U.S. Pat. No. 4,313,124 are adopted, a further excellent recording operation can be performed.

In addition to the structure (a linear liquid passage or a perpendicular liquid passage) of the recording head formed by combining the discharge ports, the liquid passage and the electro-thermal conversion members disclosed in the aforesaid specifications, a structure disclosed in U.S. Pat. Nos. 4,558,333 and 4,459,600 in which the heated portion is disposed in a bent portion is included in the scope of the present invention. Furthermore, the present invention can effectively be embodied in a structure in which a common slit is made to be the discharge portion of a plurality of electro-thermal conversion members and which is disclosed in the Japanese Patent Laid-open Appln. No. 59-123670 and a structure in which an opening for absorbing thermal pressure wave is formed to align to the discharge port and which is disclosed in the Japanese Patent Appln. Laid-open No. 59-138461.

A full line type recording head having a length which corresponds to the width of the maximum recording medium which can be recorded by the recording apparatus may be a structure capable of realizing the aforesaid length and formed by combining a plurality of recording heads as disclosed in the aforesaid specifications or a structure formed by an integrally formed recording head. The present invention will enable the aforesaid effects to be exhibited further effectively. In addition, the present invention can also be effectively adapted to a structure having an interchangeable chip type recording head which can be electrically connected to the body of the apparatus or to which ink can be supplied from the body of the apparatus when it is mounted on the body of the apparatus or a carriage type recording head integrally formed to the recording head.

It is preferable to additionally provide the recording head recovery means and an auxiliary means of the recording apparatus according to the present invention because the effect of the present invention can further be stabled. Specifically, an effect can be stably performed by providing a recording head capping means, a cleaning means, a pressurizing or sucking means, an electro-thermal conversion member or another heating device or an auxiliary heating means formed by combining the aforesaid elements and by performing a previous discharge mode in which a discharge is performed individually from the recording operation. Furthermore, the recording mode of the recording apparatus may be a recording mode for recording only main color such as black and a structure may be that formed by integrally forming recording heads or a structure formed by combining a plurality of recording heads. The present invention can significantly effectively be adapted to an apparatus having a recording head of a plurality of colors or at least one full color head arranged to mix colors.

While the above-mentioned embodiments used liquid ink, ink which is solid at room temperature or ink which is softened at room temperature may be used. In the aforesaid ink jet apparatus, the temperature of the ink is usually controlled in a range from 30° C. to 70° C. to make the viscosity of ink to be in a stable discharge range and thereby ink in which is liquefied in response to a record signal supplied may be used.

Furthermore, the ink temperature rise of which is prevented by positively using the temperature rise due to the thermal energy as energy of state change from the solid state to the liquid state of ink or ink which is solidified when it is allowed to stand in order to prevent the evaporation of ink may be used. That is, ink which is liquefied by thermal energy such as ink liquefied by thermal energy supplied in response to the record signal and discharged as ink droplet or ink which is solidified when it reaches the recording medium can be employed in the present invention. In this case, ink may be, in the form of liquid or solid, held by a recess of a porous sheet or a through hole (as disclosed in the Japanese Patent Laid-open Appln. Nos. 54-56847 and 60-71260) and disposed to confront the electro-thermal conversion member.

It is most preferable that ink be discharged by the aforesaid film boiling method.

Figure 6:
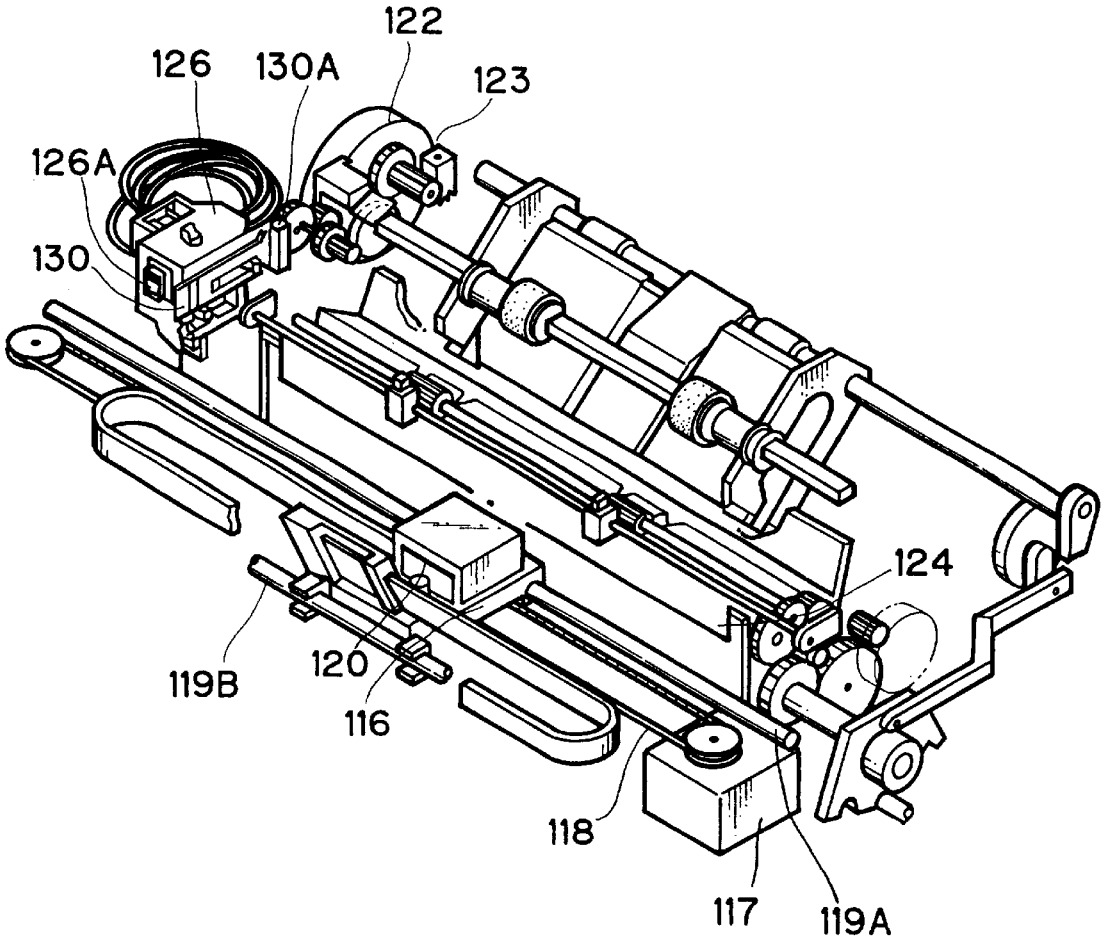
FIG. 6 is a schematic perspective view showing an example of a liquid jet recording apparatus on which a recording head according to the present invention is mounted as an ink jet head cartridge.

FIG. 6 is a perspective view showing an example of an ink jet recording apparatus (IJRA) on which the recording head presented by the present invention is mounted as an ink jet head cartridge (IJC).

In FIG. 6, an ink jet head cartridge (IJC) 120 having a group of nozzles for discharging ink onto a recording surface of a recording sheet rested on a platen 124. The ink jet head cartridge 120 is held by a carriage 116 which can be reciprocally shifted along the whole recordable area of the ink jet head cartridge 120 by connecting to a drive belt 118 for transmitting a driving force of a drive motor 117 to the cartridge and by slidably engaged by two guide shafts 119A, 119B.

A recording head recovery device 126 is arranged at one of margins of the shifting path of the ink jet head cartridge 120 to confront a home position, for example. The recovery device 126 is driven by a motor 122 via a transmission mechanism 123 to cap the ink jet head cartridge 120. In response to the capping operation of a cap portion 126A of the head recovery device 126 to the ink jet head cartridge 120, ink is sucked by an appropriate suction means provided in the head recovery device 126 or ink is pressurized by an appropriate pressurizing means provided in an ink supply path communicating with the ink jet head cartridge 120 to positively discharge the ink from the discharge openings, thereby performing the discharge recovery treatment such as the removal of the viscous ink. Further, the ink jet head cartridge can be protected by capping it with the recovery device after the recording operation has been finished.

A wiping blade 130 made of silicone rubber is disposed on a side surface of the head recovery device 126. The wiping blade 130 is cantilevered by a blade holder 131A and is driven by the motor 122 and the transmission mechanism 123 as in the recovery device 126 to be engaged by the discharge opening surface of the ink jet head cartridge 120. Thus, at the appropriate timing during the recording operation of the ink jet head cartridge 120, or after the discharge recovery treatment by the head recovery device 126, the wiping blade 130 is protruded in the shifting path of the ink jet head cartridge 120, thus removing the ink droplets, moisture and/or dirt adhered to the discharge opening surface of the cartridge 120.

Next, the test results will be explained.

Embodiment 1

Thirty sub-assemblies for an liquid jet recording head (referred to merely as "recording head" hereinafter) to include 256 discharge openings were formed by the method shown in FIG. 3. Then, each recording head sub-assembly was cut by a diamond blade of about # 600 (having diamond diameter of 20–30 $\mu$m).

Then, the positive type dry films (trade name: OZATEC R225, made by Hexist Japan Co., Ltd.) as the solid layers in the sub-assemblies were thermally cured under the temperature of 130 for 10 minutes (per first 10 sub-assemblies), 15 minutes (per second 10 sub-assemblies) and 20 minutes (per third 10 sub-assemblies), respectively. Thereafter, the hardness of the cured solid layers was measured, and it was found that the hardnesses of the cured solid layers of first, second and third groups were higher than the pencil hardness H, 2H and 3H, respectively. Then, the recording head sub-assemblies were polished in the following manner.

Figure 2:
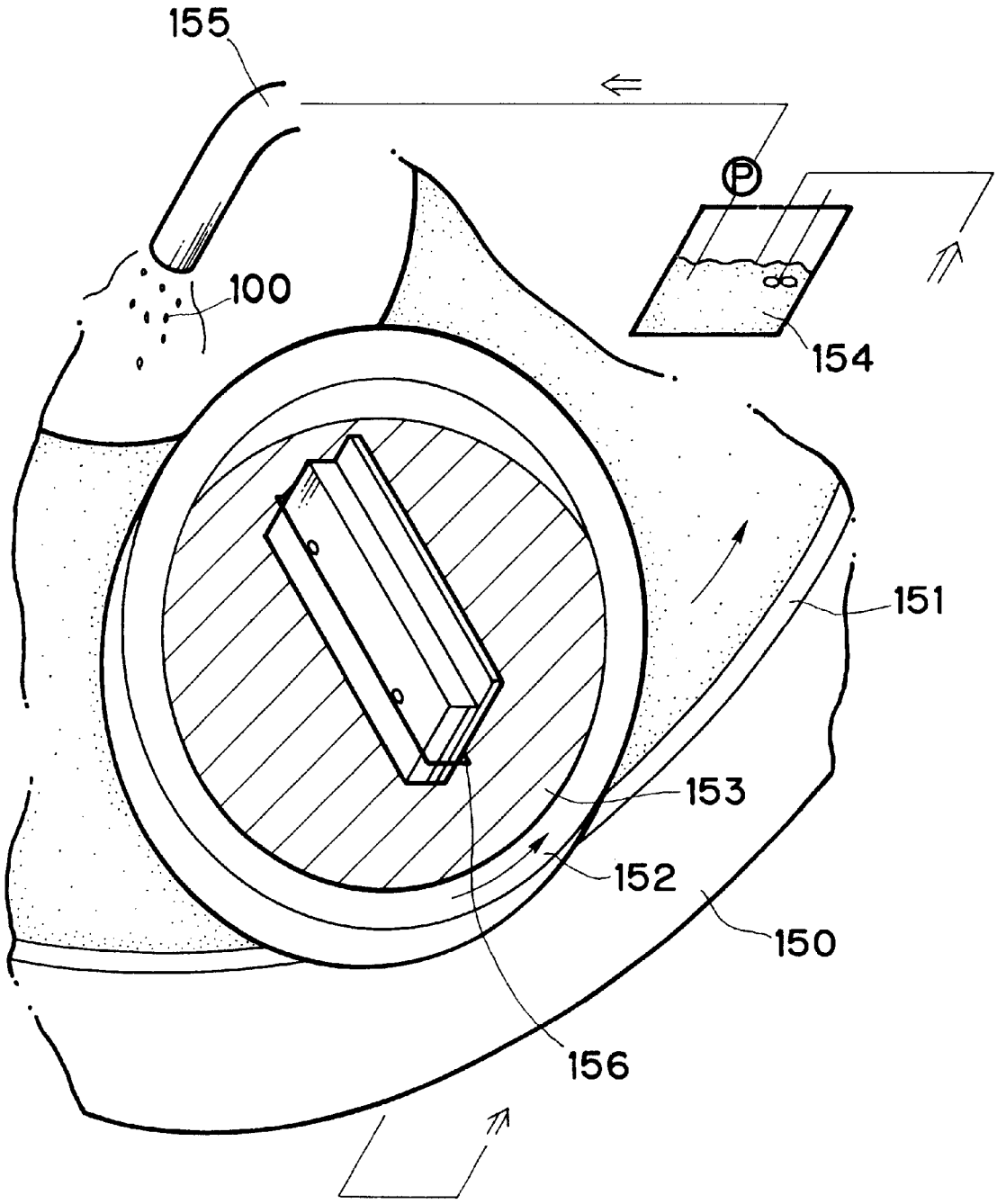
FIG. 2 is a partial perspective view showing a polishing operation.

FIG. 2 is an explanatory view for showing the polishing operation. The polishing device comprises a polisher 151 (trade name: KSP66, made by Kyushu Denki Co., Ltd.) formed on a surface of a base plate 150, and a ring 152 with a carrier 153 disposed on the polisher. The recording head sub-assembly after the cutting operation was installed within a window 156 of the carrier 153 in the ring 152 so that the discharge opening surface of the sub-assembly was contacted with the polisher 151 vertically. Then, the sub-assembly was polished by rotating the ring 152 itself and revolving the base plat 150 too while pouring a polishing liquid 100 consisting of cerium oxide and colloidal silica. The polishing speed was a few microns ($\mu$)—a few tenth microns.

Then, the recording head sub-assembly after the polishing operation was washed in a bath filling caustic soda as the solid layer removing liquid, thereby removing the solid layer. As a result, thirty liquid jet recording heads having no chipping could be obtained. Incidentally, it was found that the image quality obtained by such recording heads was very excellent.

Embodiment 2

Alternatively, thirty sub-assemblies for an liquid jet recording head to include 256 discharge openings were formed by the method shown in FIG. 4. Then, the positive type resist (trade name: AZ4903, made by Hexist Japan Co., Ltd.) as a filler was loaded in the liquid passages of each recording head sub-assembly. Then, the fillers were thermally cured under the temperature of 130 for 10 minutes (per first 10 sub-assemblies), 15 minutes (per second 10 sub-assemblies) and 20 minutes (per third 10 sub-assemblies), respectively. Thereafter, the hardness of the cured fillers was measured, and it was found that the hardnesses of the cured fillers of first, second and third groups were higher than the pencil hardness 1.3H, 2.5H and 3.6H, respectively.

After the cutting and polishing operations, similar to the Embodiment 1, the recording head sub-assemblies were washed by caustic soda. As a result, thirty liquid jet recording heads having no pitching could be obtained. Incidentally, it was found that the image quality obtained by such recording heads was very excellent.

Comparison Example 1

Ten liquid jet recording heads were formed in the same manner as the Embodiment 1 except for the fact that the solid layers were not thermally cured. As a result, it was found that the chipping occured at a rate of 0.18% in the head. Further, the image quality obtained by such recording heads was inferior to that obtained by the Embodiment 1.

Comparison Example 2

Ten liquid jet recording heads were formed in the same manner as the Embodiment 2 except for the fact that the fillers were not thermally cured. As a result, it was found that the chipping occured at a rate of 0.21% in the head. Further, the image quality obtained by such recording heads was inferior to that obtained by the Embodiment 2.

As mentioned above, it is possible to manufacture liquid passages with discharge openings having no pitching by performing the polishing operation and the solid layer or filler removing operation after the solid layer or filler has been cured to become harder than the pencil hardness H by thermally curing the solid layer or filler. As a result, the image quality obtainable by the recording head of high density multi-array type can be remarkably improved. Further, the yield rate which greatly affects the manufacturing cost can be improved, thus making the manufacturing cost of the recording head inexpensive.

What is claimed is:

1. A method for manufacturing a liquid jet recording head provided with a plurality of discharge openings for discharging a liquid and a plurality of associated liquid passages communicated therewith, comprising the steps of:

forming a solid layer made of a positive-type photosensitive resin on a substrate, corresponding to a pattern of the liquid passages to be formed, the solid layer having a plurality of recessed portions;

forming liquid passage walls by laminating a liquid passage wall forming member to the solid layer;

hardening the liquid passage walls by adding a filler material, wherein the filler material is made of a positive-type resist, and the hardening of the filler material is effected by heating the filler material for a period of ten to twenty minutes at a temperature of 130 degrees Celsius;

heating the solid layer to a hardness equal to at least a pencil hardness H;

polishing a surface on which the discharge openings communicating with the liquid passages are disposed; and removing, after the polishing is completed, the filler material from the liquid passages.

2. A method for manufacturing a liquid jet recording head provided with a plurality of discharge openings for discharging a liquid and a plurality of associated liquid passages communicated therewith, comprising the steps of:

forming a solid layer made of a positive-type photosensitive resin on a substrate, corresponding to a pattern of the liquid passages to be formed, the solid layer having a plurality of recessed portions, so that pairs of the discharge openings are disposed at opposite sides;

forming a plurality of liquid passage walls by laminating a liquid passage wall forming member to the solid layer;

hardening the liquid passage walls by adding a filler material, wherein the filler material is made of a positive-type resist, and the hardening of the filler material is effected by heating the filler material for a period of ten to twenty minutes at a temperature of 130 degrees Celsius;

cutting the substrate, solid layer and liquid passage walls at a central position between both the opposite sides;

irradiating an active energy onto the solid layer to increase a solubility of the photosensitive resin;

heating the solid layer to a hardness equal to at least a pencil hardness H;

polishing a surface on which the discharge openings communicating with the liquid passages are disposed; and removing, after the polishing is completed, the filler material from the liquid passages.

* * * * *